US006953160B2

(12) United States Patent
Sundholm

(10) Patent No.: US 6,953,160 B2
(45) Date of Patent: Oct. 11, 2005

(54) EXPANDING MOUNTING ASSEMBLY FOR MOUNTING A SPRAYHEAD TO A WALL

(75) Inventor: Göran Sundholm, Tuusula (FI)

(73) Assignee: Marioff Corporation Oy, Vantaa (FI)

( * ) Notice: Subject to any disclaimer, the term of this patent is extended or adjusted under 35 U.S.C. 154(b) by 112 days.

(21) Appl. No.: 10/273,373

(22) Filed: Oct. 17, 2002

(65) Prior Publication Data

US 2003/0066657 A1 Apr. 10, 2003

Related U.S. Application Data

(63) Continuation of application No. PCT/FI01/00472, filed on May 15, 2001.

(30) Foreign Application Priority Data

May 16, 2000 (FI) ..... 20001173

(51) Int. Cl.[7] ..... B05B 15/06
(52) U.S. Cl. ..... 239/282; 169/37
(58) Field of Search ..... 239/283, 282; 169/37, 90, 38, 39, 40, 41; 285/215, 216

(56) References Cited

U.S. PATENT DOCUMENTS 698,471 A * 4/1902 Drake ..... 285/215
2,472,569 A * 6/1949 Caldwell et al. ..... 285/210
2,965,308 A * 12/1960 Holdren ..... 239/567
3,554,277 A * 1/1971 Bauer et al. ..... 166/338
4,411,458 A 10/1983 Strunk et al. ..... 285/196
4,872,512 A * 10/1989 Multer ..... 169/51
5,921,322 A 7/1999 Bonfield et al. ..... 169/37

FOREIGN PATENT DOCUMENTS

| | | |
|---|---|---|
| EP | 0502238 | 9/1992 |
| GB | 1527358 | 10/1978 |
| JP | 0422372 | 1/1992 |
| WO | 9934872 | 7/1999 |

* cited by examiner

*Primary Examiner*—Christopher Kim
(74) *Attorney, Agent, or Firm*—Ladas & Parry LLP

(57) ABSTRACT

Mounting assembly for mounting a spray head (4) to an opening of an over 10-mm thick wall. The mounting assembly comprises a holder (1) for receiving the spray head (4) and a clamping piece (6) which comprises threads (7) for engaging threads (2) in the holder (1) and it can be moved axially in relation to the holder (1) and an expansion means (11) supported by the holder, the clamping piece (6) being arranged so that movement thereof causes movement of the expansion means (11) from its zero position, in which the diameter of the expansion means has a first value, to a fastening position, in which the diameter of the expansion means has increased to a second value for pressing the expansion means against a wall of the opening. The invention also relates to mounting assembly for mounting a spray head to an at most 30-mm thick wall.

9 Claims, 4 Drawing Sheets

EXPANDING MOUNTING ASSEMBLY FOR MOUNTING A SPRAYHEAD TO A WALL

This is a continuation of application No. PCT/FI01/00472, filed May 15, 2001.

BACKGROUND OF THE INVENTION

The invention relates to a mounting assembly for mounting a spray head, especially one used in fire fighting, to an opening in a wall. More specifically, the invention relates to a mounting assembly for mounting a spray head to walls of different thicknesses, according to the preambles of the accompanying claims. The wall may be vertical, horizontal or at any angle. Herein, the term 'wall' thus also refers to ceilings, for instance.

The invention also relates to combinations of a spray head and a spray head mounting assembly, according to the preambles of the accompanying claims.

Spray heads used in fire fighting are mounted on different bases and fastening points depending on the application. The present invention relates to mounting spray heads to walls, which is the usual way of mounting spray heads. The walls are typically either horizontal or vertical.

International patent application No. WO 99/34872 discloses mounting assembly for mounting a spray head to an opening in a wall. The mounting assembly comprises a holder which is fastened by screws to the wall and has threads for receiving the spray head. When the holder is screwed to the wall, its angle of rotation to the opening in the wall cannot be changed without loosening the screws and fastening them to another point of the wall. Such mounting assembly is difficult to install, especially if the spray head to be fastened to the holder is asymmetric, i.e. directional, which will be discussed in the following.

Mounting spray heads to thick walls in particular is time-consuming and difficult especially when a firm and stylish mounting is required. It is especially difficult to mount a spray head to an opening extending through a thick concrete wall so that the supply line of the spray head is behind the wall. As known, the spray head can be bolted (or screwed) to the wall, in which case the spray head comprises a flange having holes on the rim, through which bolts (screws) are drawn into the concrete wall. This is a difficult mounting method, because it requires drilling holes in the concrete wall and using inserts, or the like, to which the bolts (screws) tighten. Concrete tends to crack when holes are drilled into it, because the holes must, in practice, be located very close to the opening in the wall.

Spray heads are sometimes designed to spray asymmetrically to the side(s). The spray pattern can be inclined to the side or inclined downwards, or asymmetric in another manner according to the requirements of the mounting location. These asymmetric, i.e. directional, spray heads must be mounted at a certain angle (of rotation) in relation to the opening in the wall to achieve the required spray direction.

As known, directional spray heads are mounted to the supply line by means of an elastic hose or pipe. By flexing the hose and pipe allow the spray head to be turned enough so as to mount the spray head at a desired angle, after which the spray head is fastened with bolts, or the like, to the wall. The fastening to the wall is necessary, because a pipe or especially a hose does not function as a sufficiently firm support to the spray head. If the operating pressure of the spray head is very high, for instance over 50 bar, the fastening must be especially firm.

As known, a directional spray head can be fastened to a rigid supply pipe by means of a rotatable sleeve with a PTFE tape (Teflon tape) installed between the threads of the sleeve and the supply pipe. The PTFE tape allows the spray head to be fastened to the supply pipe relatively rigidly in the desired angle so that rotation of the spray head is unlikely to occur, and the tape also acts as a sealing. Mounting the spray head in such a way only on the supply pipe does not, however, provide a sufficiently rigid fastening for all applications, especially if the spray head shall be able to work with a high operating pressure. In such conditions, the spray head must additionally be fastened to the wall e.g. with bolts (as mentioned above).

When a spray head, typically a sprinkler, i.e. a spray head with a heat-explosive glass ampoule or another means which breaks or melts in high temperatures, fastened to a wall using the known methods is triggered due to a fire, it must be removed after use and replaced with a new one. If the spray head being replaced is of the directional type, a new spray head typically does not settle at the same angle of rotation so that its nozzles spray into the same direction as those of the earlier spray head. This is because the starting point of the threads of individual spray heads varies due to manufacturing reasons. Because of this, difficult special action must be taken in mounting a new directional spray head, such as bending of hoses/pipes and/or drilling new holes in the wall and installing new inserts, so as to achieve the correct angle for the nozzle(s) of the spray head.

BRIEF DESCRIPTION OF THE INVENTION

It is an object of the present invention to provide a novel mounting assembly which is suited for mounting a spray head to walls of different thicknesses and which at least partially address the above-mentioned drawbacks.

To achieve this, the mounting assembly of the invention, which is intended for mounting a spray head to an over 10-mm thick wall, is characterized in that it comprises a clamping piece which comprises threads for engaging threads in the holder and whereby it can be moved axially in relation to the holder, and an expansion means supported by the holder, the clamping piece being arranged so that movement thereof causes movement of the expansion means from its zero position, in which a diameter of the expansion means has a first value, to a fastening position, in which the diameter of the expansion means has increased to a second value for pressing the expansion means against a wall of the opening for the purpose of fastening the spray head to the wall.

To achieve this, the mounting assembly of the invention, which is intended for mounting a spray head to a less than 30-mm thick wall, is characterized in that it comprises a clamping piece which comprises threads for engaging threads in the holder and whereby it can be moved axially in relation to the holder, a flange support which comprises a sleeve-like piece comprising a sleeve portion for insertion into the opening and having an internal opening therethrough, and at one end of the sleeve portion a flange-like piece for fastening to the facing surface of the wall; and an expansion means supported by the holder, the clamping piece being arranged so that movement thereof causes movement of the expansion means from its zero position, in which a diameter of the expansion means has a first value which is smaller than a diameter of the internal opening of the sleeve-like piece, to a fastening position, in which the diameter of the expansion means increases to a second value for pressing the expansion means against a wall of the internal opening in the sleeve-like piece for the purpose of fastening the spray head to the wall through the sleeve-like piece Preferred embodiments of the mounting assembly of the invention are disclosed in the attached claims.

Combinations of the spray head and the spray head mounting assembly are characterized by what is stated in the characterizing parts of the attached claims.

The biggest potential advantages of the mounting assembly of the invention are that they provide a very simple, fast and firm mounting and remounting, of a spray head, even if this were a directional spray head providing an asymmetric spray, to a wall. The spray head need not be bolted or screwed to the wall. Thus, it is easy to replace a directional spray head with a new one after it has been triggered, even though the threads of a new spray head begin at an arbitrary point. The identical main components of the mounting assembly are suited for both thin and thick walls. The biggest advantages of the combinations of the spray head and the spray head mounting assembly are the same as the advantages of the mounting assembly. The combinations provide the additional advantage that loosening the spray head from the holder does not turn the clamping piece towards the open position, thus making the expansion means move towards the zero position, but instead, loosening the spray head turns the clamping piece towards the direction where the expansion means press even tighter against the sleeve-like piece of the wall or flange support. Due to this, the spray head is always easy to remove without the holder detaching from the wall or the flange support.

BRIEF DESCRIPTION OF THE FIGURES

In the following, the invention will be described in greater detail by means of alternative implementations and with reference to the attached drawing in which.

DETAILED DESCRIPTION OF THE INVENTION

Figure 1:
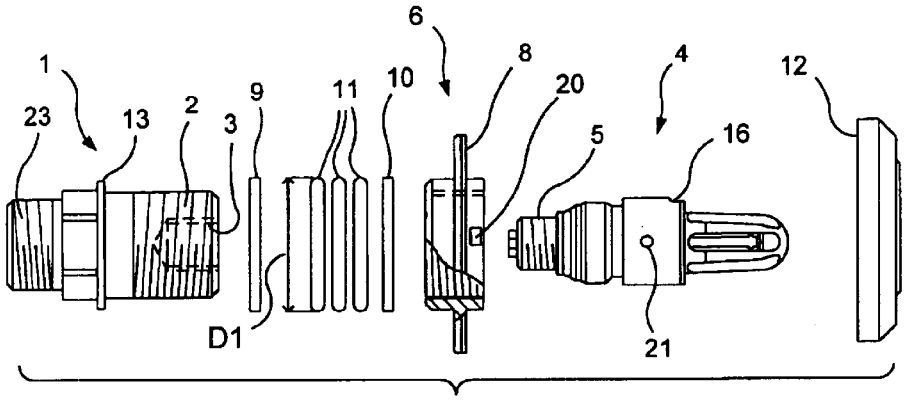
FIG. 1 shows an exploded view of a preferred embodiment of the mounting assembly of the invention, and a spray head to be fastened to the mounting assembly.

The mounting assembly shown in FIG. 1 comprises a holder 1, the first end of which has male threads 23 for fastening to a supply pipe 24 (FIG. 3), and the other end of the holder comprises left-handed male threads 2. The latter end also has female threads 3 for receiving the corresponding male threads 5 of the spray head 4 so that the spray head can be tightened to the holder 1. The sleeve-like clamping piece 6, which comprises female threads 7 (FIG. 2) corresponding to the male threads 2 of the holder, can be moved by means of said threads in the axial direction of the holder 1. The clamping piece 6 comprises a flange 8.

Reference numbers 9 and 10 indicate spacing plates (base plates) and reference number 11 indicates rubber o-rings which are between them and form the expansion means of the mounting assembly. The number of the o-rings 11 may vary; one is enough, but typically there are several. The cross-profile of the o-rings 11 need not be a circle (c.f. e.g. FIG. 8).

Figure 3:
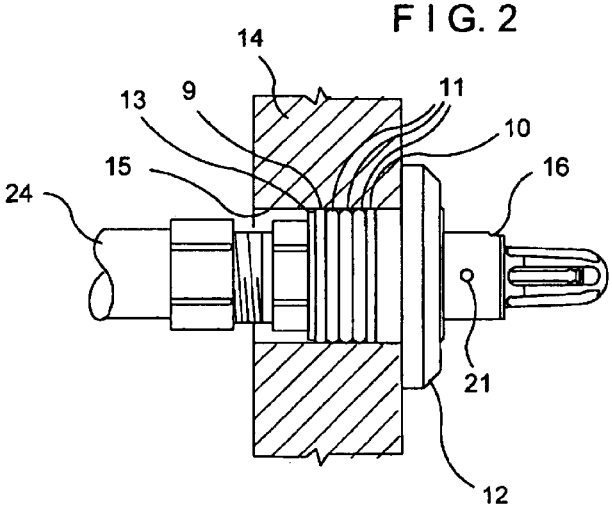
FIG. 3 illustrates the mounting assembly and spray head of FIG. 1 from the side and mounted to a thick wall, such as a concrete wall.

When the spacing plates 9, 10 and the o-rings 11 are placed on the holder 1 and the clamping piece 6 is drawn deep enough on the holder, the o-rings are pressed between the spacing plates 9, 10, as shown in FIG. 3. The spacing plate 9 is then supported on the left by a circular collar 13 in the holder 1, which collar forms a shoulder. In principle, any stop element can, instead of the shoulder, act as support to the spacing plate 9. The deeper towards the end of the holder 1 pointing towards the supply pipe 24 the clamping piece 6 is drawn, the more the o-rings 11 are pressed and consequently narrow and their diameter D1 increases. Due to this, the o-rings 11 can be called expansion means or expansion devices. Owing to the increase of the diameter of the o-rings 11, the holder 1 with its spray head 4 can be fastened to an opening 15 in a wall 14, as shown in FIG. 3. When the spray head is fastened, the o-rings 11 press against the wall (i.e. side wall) of the opening.

Reference number 12 indicates a covering plate which is in the form of a decorative ring and ensures a stylish mounting of the spray head. Typically the flange 8 of the clamping piece 6 abuts the wall when the spray head 4 has been mounted.

The mounting of the holder 1 and the spray head 4 is done for instance as follows: first the holder 1 with its spacing plates 9, 10, o-rings 11 and clamping piece 6 is wound to the supply pipe 24 of the spray head on the left side of the concrete wall 14, as shown in FIG. 3. After this, a first tool (not shown) is used to take a hold of the planar clamping surface 16 on the spray head 4 and the spray head is wound tight to the holder 1. The combination of the spray head 4, holder 1 and pipe 24 is turned with said tool to an angle of rotation that the nozzles 21 of the spray head point to the desired direction. Turning to the desired angle of rotation is possible even though the holder 1 is tightened to the supply pipe 24 and the spray head 4 is tightened to the holder, because the supply pipe and/or the pipe following it (not shown) give sufficiently. A second tool (not shown) is placed in the grooves 18 to 20 of the clamping piece 6 and the clamping piece is turned counter-clockwise, i.e. towards the inside, while the spray head is held with the first tool at the correct angle of rotation. The grooves 18 to 20 define gripping shoulders for the second tool. Instead of the grooves 18 to 20, the gripping shoulders can be formed by other means known to a person skilled in the art. The clamping piece 6 is wound so far that the o-rings 11 change from zero position, in which they are at a distance from the wall of the opening 15, to clamping position against the wall of the opening 15. The spray head 4 is now in its correct position and firmly mounted to the wall 14.

Figure 2:
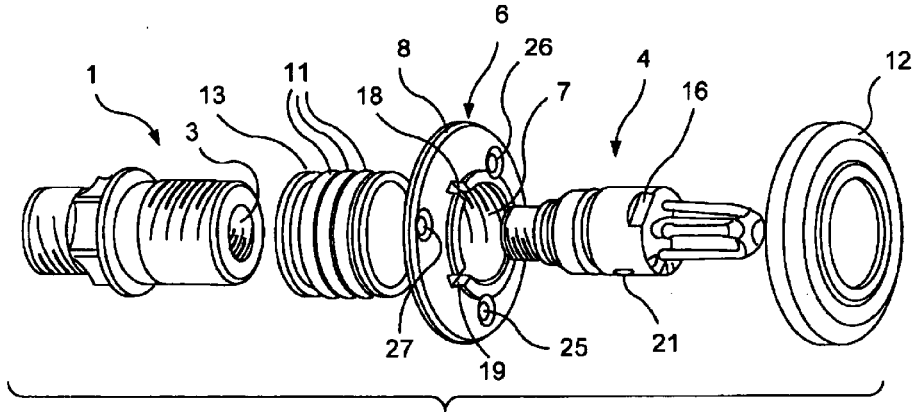
FIG. 2 shows an axonometric exploded view of the mounting assembly and spray head of FIG. 1.
Figure 6:
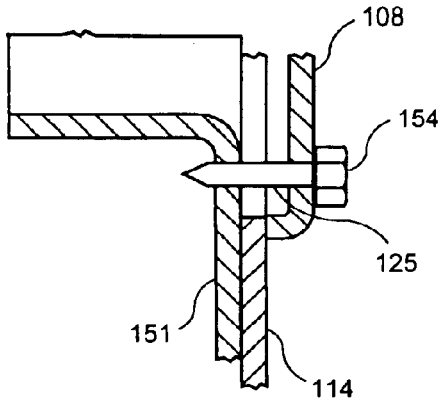
FIG. 6 illustrates an alternative implementation of a detail of the implementations in FIGS. 3 and 5, FIGS. 7 and 8 show an alternative implementation of FIGS. 1 and 2.

FIG. 2 shows that the flange 8 of the clamping piece (flange 108 in FIG. 6) has three holes 25 to 27 (hole 125 in FIG. 6), with which the flange can, when necessary, be fastened to the wall by bolts or screws (reference number 154 in FIG. 6). This fastening is usually not necessary, because the o-rings provide a good fastening.

Figure 4:
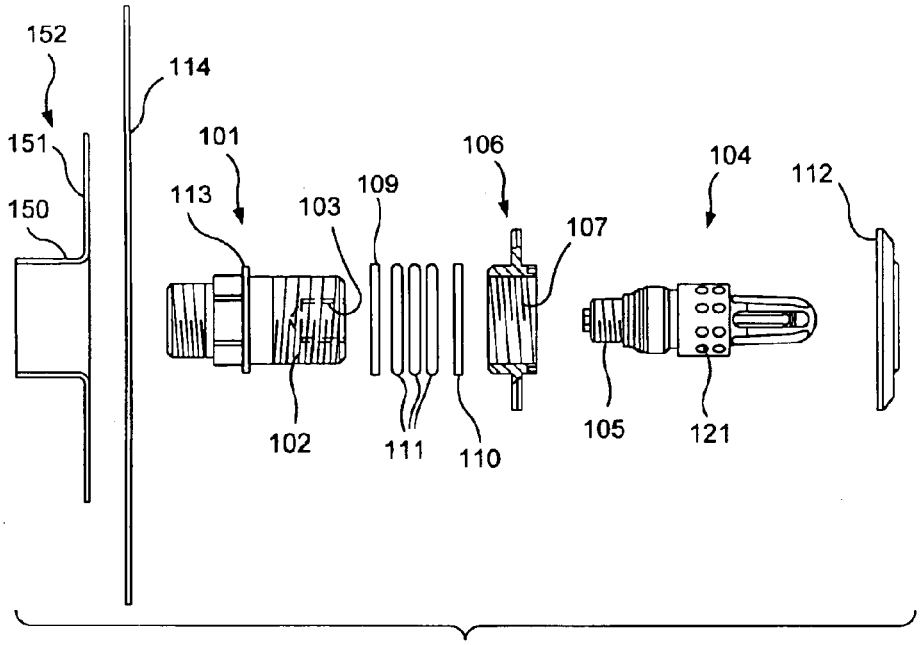
FIG. 4 illustrates a second implementation of the mounting assembly.

FIG. 4 shows mounting assembly for mounting a spray head 104 to a thin wall 114 which has a opening. The spray head 104 is similar to that in FIGS. 1 to 3 even though there are several nozzles 121. The spray head in FIG. 4 has a clamping surface corresponding to the planar clamping surface 16 of FIG. 1 even though it does not appear from the figure. The holder 101, spacing plates 109, 110, o-rings 111 and clamping piece 106 are also exactly the same as in FIG. 1. Because of this, the reference numbers of the parts correspond to those of FIG. 1. In FIG. 4, a locking ring 113, which is installed in a groove in the holder 1, forms a circular collar and shoulder to support the spacing plate 109 from the side. Instead of such a locking ring 113, there could be a circular collar 13 integrated to the holder as in FIG. 1 (and FIG. 1 could correspondingly have a similar locking ring as shown in FIG. 4).

The mounting assembly of FIG. 4 differ substantially from that in FIG. 2 only in that it has a flange support 152 comprising a sleeve-like piece 150 and a flange-like piece 151 and intended for fastening to a thin wall 114. The purpose of the flange support 152 is to act as a member which settles against the facing surface of the wall 114 and against which the o-rings 111 press when the spray head 104 has been mounted. The sleeve-like piece 150 in a way analogous to the wall of the opening 15 in FIG. 3.

Figure 5:
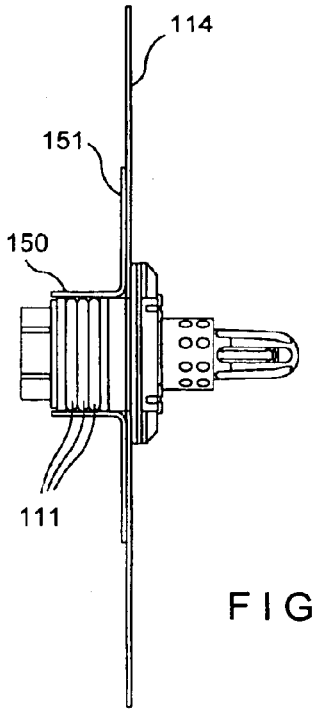
FIG. 5 illustrates the mounting assembly and spray head of FIG. 4 from the side and mounted to a thin wall, such as a metal sheet wall.

In FIG. 5, the flange-like piece 151 is fastened by glue to the facing surface of the wall 114 and the o-rings 111 press against the sleeve-like piece 150, thus keeping the spray head—holder combination in place. The flange-like piece 151 can alternatively be fastened to the wall 114 by screws 154 extending through the holes 125 in the flange 108, which fasten to the flange-like piece 151, as in FIG. 6. The hole 125 is analogous to the hole 25 in FIG. 2. It can be thought that instead of a glue or screw joint the flange support 152 fastens stationary to the wall 114 with only a friction joint preventing the combination of a spray head and a spray head mounting assembly from rotating in the opening. This is possible, since the clamping piece 106 moves at the same time in the axial direction of the holder 101 as it presses the o-rings 111 against the sleeve-like piece 150, and when the flange-like piece 151 moves, it presses against the facing surface of the wall 114, which is compressed between the flange support 152 and the flange like piece 151.

Figure 7:
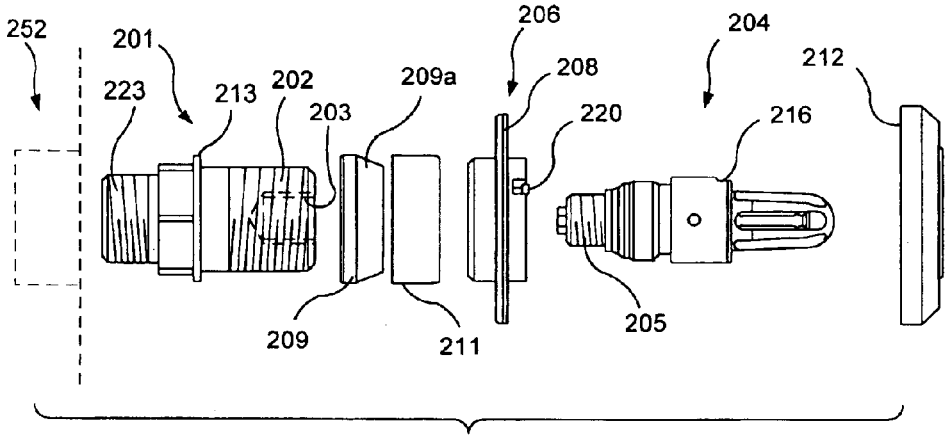

FIG. 7 shows mounting assembly differing from the mounting assembly in FIG. 1 and a spray head 204. FIG. 7 uses reference numbering corresponding to that in FIG. 1. The embodiment of FIG. 7 differs from the embodiment of FIG. 1 in that it comprises a conical ring piece 209 placed around the holder 201, the conical surface 209*a* being intended to fit inside a cylindrical elastic piece 211. The piece 211 is made of rubber or plastic, for instance, but can be made of a rigid material such as steel. If the rim of the piece comprises a split point, the piece can be made of a rigid material, such as metal, and it is recommended that it be spring-like allowing elastic changes in the diameter (i.e. the piece 211 flexing elastically). Instead of the uniform conical surface 209*a*, the ring piece 209 may comprise a group of wedge-shaped surfaces. The locking ring 213 forms a circular collar.

Figure 9:
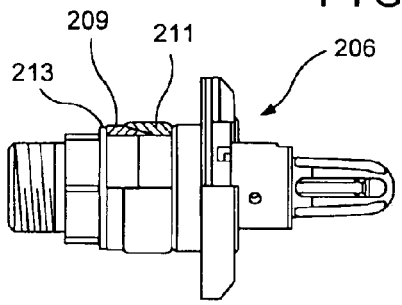
FIG. 9 shows the implementation of FIGS. 7 and 8 when assembled.

FIG. 9 shows the structure of FIG. 7 when assembled. It will be understood from the figure that the conical ring piece 209 and cylindrical piece 211 are pressed between the locking ring 213 (or another stop means) and clamping ring 206. The more the clamping ring 206 is tightened, the more the conical ring piece 209 pushes inside the cylindrical piece 211 expanding it. The inner surface of the cylindrical piece 211 is bevelled to facilitate the interaction of the conical ring piece 209 and the cylindrical piece 211.

Figure 8:
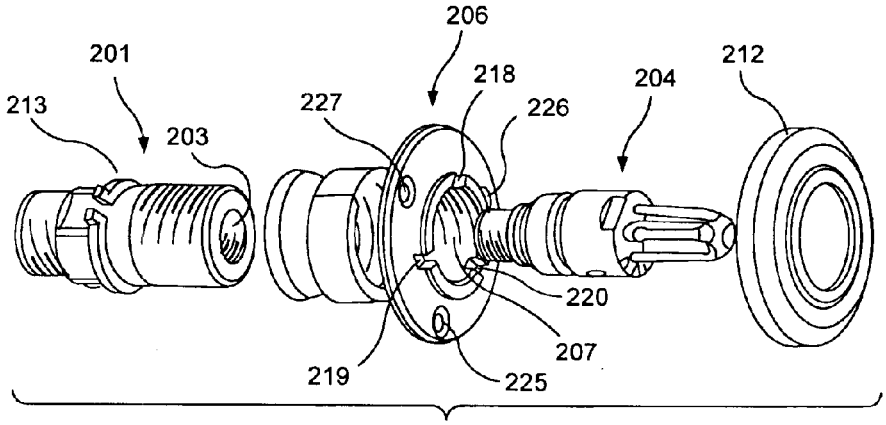

The solution of FIGS. 7 to 9 provides the advantage that the structure is simple and the diameter of the cylindrical piece 211 can be efficiently adjusted. It can be thought that in FIG. 7, the section on the left side of the flange 208 of the clamping ring 206 is made conical, in which case the conical ring piece 209 on the left side of the cylindrical piece is not necessarily needed.

The solution of FIG. 7 can also comprise a flange support as shown in FIG. 4, if the mounting is to be to a thin wall as shown in FIG. 5. A dashed line shows this optional flange support 252 corresponding to the flange support 152 of FIG. 4.

Figure 10:
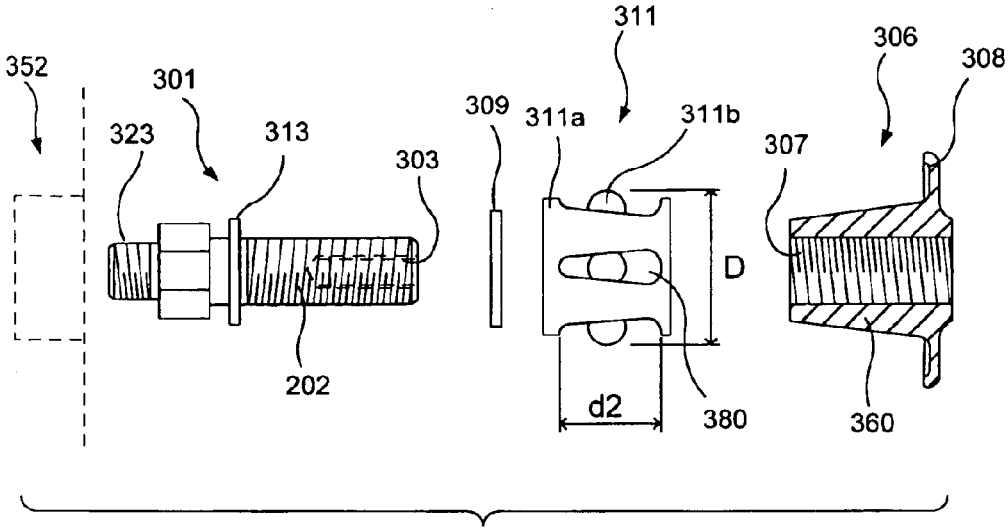
FIG. 10 shows an exploded view of yet another implementation of the mounting assembly of the invention.

FIG. 10 shows yet another way of implementing the mounting assembly of the invention. The reference numbering in the figure follows that of FIGS. 1 and 7. The dashed line shows an optional flange support 352. The mounting assembly shown in FIG. 10 differs from those in FIGS. 1 and 7 in that the clamping piece 306 has a conical surface 360 and instead of the expansion means in the form of the o-rings 11 and the cylindrical piece 211, an expansion means 311 comprising four balls 311*b* fitted into a holder ring 311*a* is used. The number of the balls 311*b* must be at least three and, in practice, it can be at most eight. The purpose of the holder ring 311*a* is to facilitate the mounting by keeping the balls 311*b* in place so that they will not drop off during mounting. For this purpose, the holder ring 311*a* has elongated widening openings 380 for the balls 311*b*. The smaller diameter d1 of the openings 380 is along the entire length d2 of the opening smaller than the diameter of the balls 311*b*, whereby the walls of the openings 380 guide the balls and stop them from dropping. When the clamping piece 306 is turned counter-clockwise, the holder ring 311*a* is supported from the left by the spacing plate 309, and the balls move along the conical surface 360 of the clamping piece and along the openings of the holder ring away from the centre axis of the holder, which causes the diameter D defined by the balls to increase. When the mounting assembly of FIG. 10 is mounted to the wall 14 of FIG. 3, or to the wall 114 of FIG. 5 with its flange support 152, the balls settle to press against the wall of the opening 15, and correspondingly against the sleeve-like piece 150 of the flange support, thus settling the expansion means formed by the holder ring and the balls in its fastening position.

In the above, the invention has only been described using examples and therefore it should be noted that the invention may vary in detail in many ways within the scope of the attached claims. Thus, the design of the holder or the clamping piece, for instance, may vary. Other types of elements than o-rings, conical ring pieces or balls can be used as the expansion means. The outer periphery of the expansion means does necessarily have the form of a circle and the expansion means does not necessarily have to be symmetrical with respect to the holder. The interacting threads of the spray head and holder need not be right-handed; if they are left-handed, the interacting threads of the clamping piece and the holder are preferably right-handed due to the above clamping function.

What is claimed is:

1. In a mounting assembly for mounting a spray head for fire fighting to an opening of a less than 30-mm thick wall, the improvements comprising:

a holder for receiving the spray head;

a clamping piece which comprises threads for engaging threads in the holder the threads of the clamping piece and the threads of the holder providing for axial movement of the clamping piece in relation to the holder;

a flange support which comprises a sleeve-like piece comprising a sleeve portion having an internal opening therethrough, and at one end of the sleeve-like piece a flange-like piece for fastening to a facing surface of the wall; and an expansion means supported by the holder, the clamping piece being arranged so that movement thereof causes movement of the expansion means from its zero position, in which a diameter of the expansion means has a first value which is smaller than a diameter of the internal opening of the sleeve-like piece, to a fastening position, in which the diameter of the expansion means has increased to a second value for pressing the expansion means against a wall of the internal opening in the sleeve-like piece for fastening the spray head to the wall.

2. In a mounting assembly for mounting a spray head for fire fighting to an opening of an over 10-mm thick wall, the improvements comprising a holder for receiving the spray head, a clamping piece which comprises threads for engaging threads in the holder the threads of the clamping piece and the threads of the holder providing for axial movement of the clamping piece in relation to the holder, and an expansion means supported by the holder, the clamping piece being arranged so that movement thereof causes movement of the expansion means from its zero position, in which a diameter of the expansion means has a first value, to a fastening position, in which the diameter of the expansion means has increased to a second value for pressing the expansion means against a wall of the opening for the purpose of fastening the spray head to the wall, wherein the expansion means comprises an elastic piece and the elastic piece is mounted against a conical surface of a conical piece.

3. In a combination of a spray head and a mounting assembly for mounting the spray head to an opening of a less than 30-mm thick wall, the improvements comprising:

a holder which comprises threads for receiving the spray head in a rotatable manner;

a clamping piece which comprises threads for engaging threads in the holder the threads of the clamping piece and the threads of the holder providing for axial movement of the clamping piece in relation to the holder;

a flange support which comprises a sleeve-like piece comprising a sleeve portion having an internal opening therethrough, and at one end of the sleeve-like piece a flange-like piece for fastening to the facing surface of the wall; and an expansion means supported by the holder, the clamping piece being arranged so that movement thereof causes movement of the expansion means from its zero position, in which a diameter of the expansion means has a first value which is smaller than a diameter of the internal opening of the sleeve-like piece, to a fastening position, in which the diameter of the expansion means has increased to a second value for pressing the expansion means against a wall of the internal opening in the sleeve-like piece for the purpose of fastening the spray head to the wall through the sleeve-like piece, and the spray head comprising threads the direction of which is opposite to that of the threads of the clamping piece.

4. Mounting assembly as claimed in claim 1, wherein the expansion means comprises an elastic piece.

5. Mounting assembly as claimed in claim 1, wherein the ring piece is fitted between two pressing surfaces.

6. Mounting assembly as claimed in claim 1, wherein the clamping piece comprises a narrowing section and the expansion means comprises at least three moving pieces which are arranged to move radially outward of the holder, with respect to an axis of the holder, guided by the narrowing section, when the clamping piece is moved.

7. Mounting assembly as claimed in claim 1, wherein the clamping piece comprises a sleeve-like piece to which a flange is formed.

8. Mounting assembly as claimed in claim 1, wherein the threads of the clamping piece are left-handed.

9. Mounting assembly as claimed in claim 1, wherein the clamping piece comprises a sleeve-like piece to which a flange is formed.

* * * * *